US009147952B2

(12) United States Patent
Kikuchi et al.

(10) Patent No.: US 9,147,952 B2
(45) Date of Patent: Sep. 29, 2015

(54) ELECTRICAL CONNECTOR ASSEMBLED COMPONENT

(71) Applicant: Hirose Electric Co., Ltd., Tokyo (JP)

(72) Inventors: Takashi Kikuchi, Santa Clara, CA (US); Atsushi Matsuzawa, Tokyo (JP)

(73) Assignee: HIROSE ELECTRIC CO., LTD., Toyko (JP)

( * ) Notice: Subject to any disclaimer, the term of this patent is extended or adjusted under 35 U.S.C. 154(b) by 65 days.

(21) Appl. No.: 14/101,649

(22) Filed: Dec. 10, 2013

(65) Prior Publication Data

US 2014/0170886 A1 Jun. 19, 2014

(30) Foreign Application Priority Data

Dec. 18, 2012 (JP) ..... 2012-275677

(51) Int. Cl.

| | |
|---|---|
| ***H01R 13/625*** | (2006.01) |
| ***H01R 12/70*** | (2011.01) |
| ***H01R 13/627*** | (2006.01) |
| ***H01R 13/424*** | (2006.01) |
| *H01R 12/73* | (2011.01) |
| *H01R 13/187* | (2006.01) |

(52) U.S. Cl.

CPC ..... *H01R 12/7082* (2013.01); *H01R 13/424* (2013.01); *H01R 13/625* (2013.01); *H01R 13/627* (2013.01); *H01R 12/737* (2013.01); *H01R 13/187* (2013.01)

(58) Field of Classification Search

USPC ..... 439/343, 345, 246, 252, 850–852, 843, 439/79

See application file for complete search history.

(56) References Cited

U.S. PATENT DOCUMENTS

| | | | | |
|---|---|---|---|---|
| 4,749,357 | A * | 6/1988 | Foley | 439/80 |
| 4,764,121 | A * | 8/1988 | Ditzig | 439/21 |
| 5,055,055 | A * | 10/1991 | Bakker | 439/78 |
| 5,439,387 | A * | 8/1995 | Hayashi | 439/345 |
| 5,567,170 | A * | 10/1996 | Kroeber | 439/186 |
| 5,779,495 | A * | 7/1998 | Dechelette et al. | 439/353 |
| 5,807,120 | A * | 9/1998 | Matthews | 439/80 |
| 5,823,812 | A * | 10/1998 | Bhargava et al. | 439/345 |
| 6,007,361 | A * | 12/1999 | Flachslaender | 439/358 |
| 6,062,919 | A * | 5/2000 | Trafton | 439/843 |
| 6,280,245 | B1 * | 8/2001 | Han | 439/541.5 |

(Continued)

FOREIGN PATENT DOCUMENTS

JP 2011-060732 A 3/2011

*Primary Examiner* — Abdullah Riyami
*Assistant Examiner* — Harshad Patel
(74) *Attorney, Agent, or Firm* — Kubotera & Associates, LLC

(57) ABSTRACT

An electrical connector assembled component includes a first attachment connector for attaching to a first circuit board member; a second attachment connector for attaching to a second circuit member; and an intermediate connector that is provided between the first attachment connector and the second attachment connector. The intermediate connector has conducting terminals in the housing. The first attachment connector and the second attachment connector have first receiving terminals and second receiving terminals. Each conducting terminal has a first contact section; a second contact section; and a joining section. An elastic cylindrical member is made of metal and can elastically deform in the radial direction so as to allow movement of the first contact section and the second contact section. The elastic cylindrical member contacts with the first contact section and the first receiving terminal or the second contact section and the second receiving terminal.

6 Claims, 9 Drawing Sheets

(56) References Cited

U.S. PATENT DOCUMENTS

| | | | | |
|---|---|---|---|---|
| 6,561,832 | B2 * | 5/2003 | Geltsch et al. | 439/345 |
| 6,656,002 | B2 * | 12/2003 | Zhao et al. | 439/851 |
| 7,077,676 | B2 * | 7/2006 | Matsumoto et al. | 439/271 |
| 7,115,003 | B2 * | 10/2006 | Zhao et al. | 439/851 |
| 7,387,548 | B2 * | 6/2008 | Takehara et al. | 439/843 |
| 7,494,374 | B2 * | 2/2009 | Hall et al. | 439/564 |
| 7,708,578 | B1 * | 5/2010 | Lenox | 439/248 |
| 8,029,326 | B2 * | 10/2011 | Rossman | 439/843 |
| 8,142,238 | B2 * | 3/2012 | Heigl et al. | 439/843 |
| 8,202,105 | B2 * | 6/2012 | Lord et al. | 439/247 |
| 2006/0094281 | A1 * | 5/2006 | Dang | 439/352 |
| 2008/0299811 | A1 * | 12/2008 | Battista | 439/345 |
| 2009/0029584 | A1 * | 1/2009 | Sami | 439/345 |
| 2011/0312204 | A1 * | 12/2011 | Shih et al. | 439/345 |

* cited by examiner

ELECTRICAL CONNECTOR ASSEMBLED COMPONENT

BACKGROUND OF THE INVENTION AND RELATED ART STATEMENT

The present invention relates to an electrical connector assembled component. More specifically, the present invention relates to an electrical connector assembled component having conducting terminals.

As an electrical connector assembled component of this type, there has been known a conventional electrical connector assembled component disclosed in Patent Reference.

Patent Reference: Japanese Patent Application Publication No. 2011-060732

According to Patent Reference, the conventional connector assembled component includes an intermediate connector, which connects a mating connector mounted on one circuit board and another mating connector mounted on the other circuit board. In the conventional connector assembled component disclosed in Patent Reference, the intermediate connector connects the mating connectors, with the one and the other circuit boards are parallel to each other. Therefore, the two connectors and corresponding terminals of the intermediate connector are aligned in straight lines. In other words, the direction of fitting the intermediate connector to one of the mating connectors is identical to a direction of fitting the intermediate connector to the other connector.

In the conventional connector assembled component, on the both mating connectors, pin-shaped (straight) fixed contacts (terminals) that extend in a fitting direction are provided at a plurality of positions so as to be present in rows and columns on a surface perpendicular to the connector fitting direction. On the other hand, on the intermediate connector, there are provided movable contacts that are formed by bending metal strips in the strips' thickness directions so as to be able to elastically deform in the thickness directions.

In the conventional connector assembled component, each movable contact is composed of two spring pieces, which are provided as a pair that faces each other in the plate thickness direction so as to tightly press and hold one fixed contact, and those two spring pieces are put together with a linking piece at a middle position thereof in the fitting direction so as to keep a constant distance therebetween. Each spring piece of the movable contact forms a cantilever, with the linking section works as a basal part thereof. Each pair of the spring pieces forms contact sections, which has a shorter distance therebetween locally, on the both free end sides, i.e. the sides to contact with mating connectors. Such a neck-like portion formed by a pair of the spring pieces, which face each other in a direction perpendicular to the fitting direction, elastically flexes and deforms so as to receive and tightly press the fixed contact of the mating connector.

According to the conventional connector assembled component disclosed in Patent Reference, while the both mating connectors and the intermediate connector are connected, the both mating connectors can respectively move relative to the intermediate connector within allowable range in two different directions in a surface perpendicular to the fitting direction.

As for the two directions of the movements, one is a thickness direction of the spring piece of the movable contact of the intermediate connector, which is enabled by elastic deformation of the movable contact in the thickness direction upon being pressed by the fixed contact. The other is a width direction of the spring piece, which is enabled by sliding of the fixed contact along a surface of the spring piece of the movable contact.

Therefore, according to the conventional connector assembled component disclosed in Patent Reference, the two mating connectors can do so-called floating, whereby it is possible to absorb influence from displacement of the mating connectors in two directions in a surface that is perpendicular to the fitting direction.

However, in the intermediate connector of the conventional connector assembled component disclosed in Patent reference, since each movable contact is formed by bending a metal strip in a thickness direction thereof. Further, a pair of the spring pieces facing each other in the thickness direction is connected with a linking piece, and the upper and lower spring sections are connected to each other as one member. Therefore, there remains much to improve.

Furthermore, according to the intermediate connector of the conventional connector assembled component disclosed in Patent Reference, connection can be made only in a way such that the fitting directions of two mating connectors are aligned in one direction, and such intermediate connector is not suitable for connection when the circuit boards, to which the respective mating connectors are attached, are perpendicular to each other.

According to the conventional connector assembled component disclosed in Patent Reference, first, as a result of that a contact section of a terminal of the intermediate connector is formed being bent only in a thickness direction, among the above-described floating in the two directions, one is obtained as elastic deformation in the thickness direction and the other is obtained as sliding accompanying with frictional force in the thickness direction, and the moving modes due to the floating in the two directions, i.e., the force working between the fixed contact and the movable contact are different, one is elastic force and the other is frictional force.

As a result, upon movement due to the floating, when the both connectors are displaced in a direction angled from the fitting direction, and when the directions of the displacements are different, i.e. although being in a surface perpendicular to the fitting, when it shifts to a direction angled to one straight line, because of difference in the displacements and contact pressures, the difference is generated in the influence absorbing ability. In other words, for example, in case of a displacement in a direction of the elastic deformation, the contact pressure is proportional to the deformation, and the contact pressure can be high or low depending on the deformation, but in case of the displacement in the sliding direction, in regardless of the amount of movement by the sliding, the contact pressure is constant contact pressure, which is initial elastic force that the contact sections at the positions after the movement originally receive.

Second, since the spring piece is bent only in the thickness direction, the throat-shaped contact site to the fixed contact forms a straight line, and the length of the line is the maximum at one side of the quadrangle od the fixed contact that has a quadrangle section, so that the length of the contact cannot be considered sufficient and the contact area is extremely small. Moreover, when the fixed contact has a circular section, the contact site has to be a point.

Third, as described above, since the upper and the lower springs are integrally made as one piece, even when the two mating connectors displace not in the same linear direction but in different directions relative to each other because of the difference in the mode of the floating in the two directions, there is difference in the ability to absorb influence from the displacement between the mating connectors.

Fourth, since the upper and the lower springs are integrally formed as one piece, the upper and the lower springs restrict each other and enhance the rigidity by being together, so that, although the contact pressure is high in the elastic deformation direction, the elastic deformation (the amount of moving) is small, and there is no independency in the elastic deformation.

Fifth, the intermediate connector cannot be fitted and connected to the both mating connectors in one straight line direction, so that it is impossible to apply in so-called right-angle connection, in which circuit boards of the two mating connectors are disposed at a right angle from each other.

In view of the problems described above, an object of the present invention is to provide an electrical connector assembled component, in which receiving terminals of mating connectors, to which conducting terminals of an intermediate connector contact and connect at their ends, can achieve the same modes of floating at any angular positions in the circumferential direction, and which is suitable for right-angle connection.

Further objects and advantages of the present invention will be apparent from the following description of the present invention.

SUMMARY OF THE PRESENT INVENTION

In order to attain the objects described above, according to a first aspect of the present invention, an electrical connector assembled component includes a first attachment connector for attaching to a first circuit board member; a second attachment connector for attaching to a second circuit member; and an intermediate connector that is provided between the first attachment connector and the second attachment connector for connecting the first attachment connector and the second attachment connector. The intermediate connector has conducting terminals in the housing. The first attachment connector and the second attachment connector have first receiving terminals and second receiving terminals respectively, which receive axial contact sections formed on the respective corresponding end sections of the conducting terminals in their axial directions and contact with circumferential surfaces of the contact sections.

According to the first aspect of the present invention, in the electrical connector assembled component, each conducting terminal has a first contact section formed at one end; a second contact section formed at the other end; and a joining section to join the first and the second contact sections. The joining section is formed by bending the terminal, such that an axis of the first contact section and an axis of the second contact section cross each other. At least one of the first receiving terminal, the first contact section of the conducting terminal, the second receiving terminal, and the second contact section of the conducting terminal has an elastic cylindrical member that is made of metal and can elastically deform in the radial direction so as to allow generation of tilt of the first contact section and the second contact section at any angular position in the circumferential direction around their axes and movement in the radial direction. The elastic cylindrical member contacts at its circumferential surfaces with the first contact section and the first receiving terminal or with the second contact section and the second receiving terminal while being in the elastically deformed state.

According to the first aspect of the present invention, in the electrical connector assembled component configured as described above, the axes of the first attachment connector and the second attachment connector, which are also fitting directions to fit the mating connectors of the intermediate connector to the first contact sections and the second contact sections respectively provided at the ends of the conducting terminals of the intermediate connector, are perpendicular to each other. Accordingly, the receiving terminals of the first attachment connector receive the first contact sections in the axial direction and the second receiving terminals of the second attachment connector receive the second contact sections in the axial direction, and the first attachment connector and the second attachment connector, which are respectively attached onto circuit boards that are disposed in directions perpendicular to each other, are connected at a right angle relative to each other.

According to the first aspect of the present invention, even when the elastic cylindrical bodies are provided at both of the first contact sections and the second contact sections provided at the both ends of the conducting terminals with their axes are perpendicular to each other, the conducting terminals of the intermediate connector contact with the first receiving terminals of the first attachment connector and the second receiving terminals of the second attachment connector via the elastic cylindrical bodies independently provided corresponding to the first contact sections.

Therefore, the elastic cylindrical members between the first receiving terminals and the first contact sections of the conducting terminals and between the second receiving terminals and the second contact sections of the conducting terminals are independently provided from each other as described above. Accordingly, the first attachment connector and the second attachment connector can float without being influenced from each other. In addition, each elastic cylindrical member has a cylindrical shape and exhibits the same elastic characteristic in the radial direction at any angular positions in the circumferential direction, and causes the same displacement regardless of the angular position in the circumferential direction, and the floating can be achieved in the same mode.

According to a second aspect of the present invention, the joining section of each conducting terminal of the intermediate connector may be preferably formed as a strip-like section having a plate surface that is perpendicular to a surface containing the axis of the first contact section and the axis of the second contact section. With this configuration, the joining section has flexing elasticity in a direction perpendicular to the plate surface of the strip-like section and it is possible to reduce influence of the amount of movement of the first contact section on the second contact section.

According to a third aspect of the present invention, a housing of the intermediate connector may consist of two housing halves, which are two halves of the housing divided at a surface the axis of the first contact section of the conducting terminal and the axis of the second contact section. Those housing halves are preferably able to connect to each other after housing the conducting terminals therein. With this configuration, upon attaching the conducting terminals to the housing, after mounting the conducting terminals in one housing half, the other housing half can be attached thereto, so that it is easy to mount the conducting terminals of any bent shapes as long as the conducting terminals are placed on the dividing surface of the housing.

According to a fourth aspect of the present invention, the intermediate connector may be configured to have two conducting terminals and the both conducting terminals can be held by one holding member that is made of an electrically insulating material. With this configuration, since the two conducting terminals are not separated, it is easier to manage during storage and it is possible to simplify the assembling work upon mounting to the housing. In this case, in view of use of the connector after mounting into the housing, it is more preferred to configure the holding member so as to hold the both conducting terminals while providing the both conducting terminals with degree of freedom for movement relative to each other, for a purpose of not restricting the floating ability.

According to a fifth aspect of the present invention, each conducting terminal of the intermediate connector may be preferably supported by spring members, which are provided between a part of the joining section and a corresponding part of the housing, with each spring member elastically contacts with a sheet surface of the joining section. With this configuration, within the elastically displaceable range of the spring members, it is possible to support the conducting terminals while securing the floating ability.

According to a sixth aspect of the present invention, the elastic cylindrical member may be made from sheet metal by forming into a cylindrical shape, and for example, such that slits, which extend in the axial direction at a plurality of positions in the circumferential direction, can be formed between the both ends in the axial direction, and the middle part in the axial direction can have an annular neck section having smaller diameter than those at the ends in the axial direction and can house the first receiving terminal and the second receiving terminal. Such elastic cylindrical member can be configured with the side edges in the circumferential direction of the cylindrical shape formed by rolling sheet metal can be apart from each other with gap while still being able to abut to each other, or can be joined by welding or by other method, or can have space therebetween or can be overlapped to each other. The elastic displacement is the maximum at the annular neck section.

As described above, according to the present invention, the receiving terminals of the mating connectors that are respectively connected to the contact sections provided at the straight ends of conducting terminals of the intermediate connector are provided independently from each other, and a cylindrical elastic member is disposed on either the receiving terminal or the end of the conducting terminal, so as to obtain the same floating amount at any angular positions in the circumferential direction. Therefore, it is possible to secure sufficient amount of floating and sufficient contact pressure between the terminals, and it is also possible to obtain the same connection characteristics at the above-described any angular positions.

In addition, according to the present invention, since the contact sections of each conducting terminals at the ends are joined with joining sections that are formed by bending, so as to have the axes of the contact sections at the ends perpendicular to each other, it is possible to make a right-angle connection while keep their floating abilities.

BRIEF DESCRIPTION OF THE DRAWINGS

FIGS. 4(A) and 4(B) are enlarged sectional views of the electrical connector assembled component of FIG. 2 (with the two housing halves are connected), which is taken at a position of a first contact section of a long terminal, which is one of the two conducting terminals, along a surface including axis of a first contact section and a second contact section), wherein FIG. 4(A) shows a state the first contact section is at a normal position and FIG. 4(B) shows a state the first contact section is at a tilted position;

FIGS. 5(A) and 5(B) are sectional views of the electrical connector assembled component of FIG. 2, which is taken at a surface containing the axes of the first contact section and the second contact section, wherein FIG. 5(A) shows the state before connecting to the second attachment connector and FIG. 5(B) shows the state after connecting to the second attachment connector;

FIGS. 6(A) and 6(B) are sectional views of the electrical connector assembled component at a position corresponding to that in FIGS. 5(A) and 5(B), wherein FIG. 6(A) shows when a second circuit board as a circuit board member to which the second attachment connector is attached is displaced upward and FIG. 6(B) shows when the second circuit board is displaced downward;

FIGS. 7(A) and 7(B) are sectional views of the electrical connector assembled component of FIG. 2, which is taken at a surface horizontal to a surface of a first circuit board, which is provided as a circuit member to which the first attachment connector is attached, at a position of the second contact section of the long terminal, wherein FIG. 7(A) shows when the second contact section is at a normal position and FIG. 7(B) shows the second contact section is at a tilted position;

FIGS. 9(A) and 9(B) are schematic views showing a state the conducting terminals are supported with spring members formed in the housing at boundaries between the second contact sections and the joining sections of the conducting terminals according to yet another embodiment of the present invention, wherein FIG. 9(A) is a sectional view taken at a surface containing the axes of the first contact section and the second contact section, and FIG. 9(B) is a sectional view taken at a surface perpendicular to the surface.

DETAILED DESCRIPTION OF THE PREFERRED EMBODIMENTS

Hereunder, embodiments of the present invention will be described with reference to the accompanying drawings.

Figure 1:
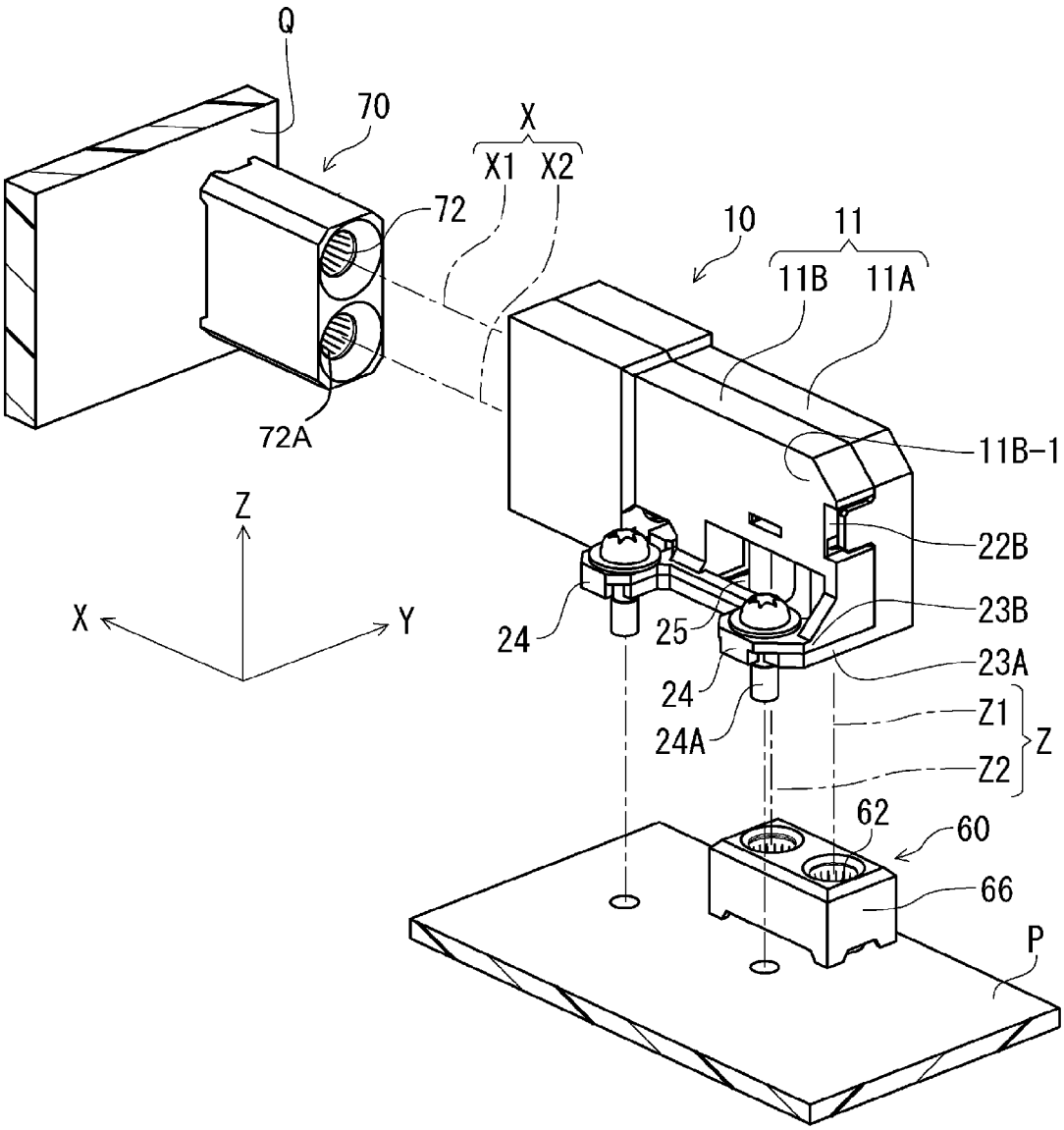
FIG. 1 is a perspective view of an electrical connector assembled component according to the present invention in a state that an intermediate connector, a first and a second attachment connectors are separated from each other before connecting to each other.
Figure 2:
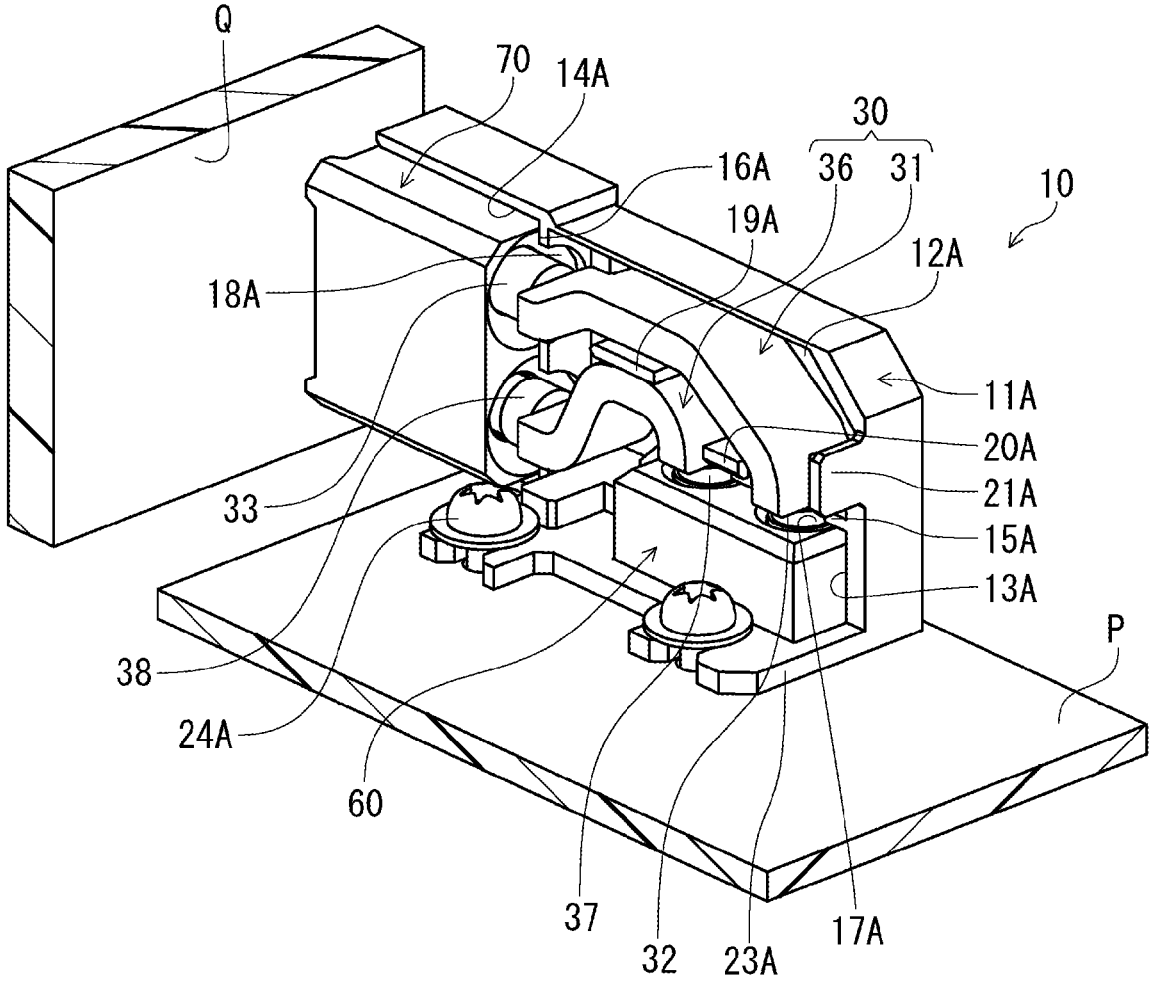
FIG. 2 is a perspective view of the electrical connector assembled component of FIG. 1 in an assembled state, wherein one housing half of the intermediate connector is detached therefrom.

FIG. 1 is a perspective view of an electrical connector assembled component of the present invention, which is composed of a first attachment connector and a second attachment connector that are connected via an intermediate connector, in state before connecting the respective connectors. FIG. 2 is a perspective view showing the state after the connection, with only one housing half of the intermediate connector is attached thereto and the other housing half is detached therefrom.

As shown in FIG. 1, the first attachment connector 60 for connecting to the intermediate connector 10 is attached to a circuit board P that is provided as a circuit member, and the second attachment connector 70 is attached to a circuit board Q that is provided as a circuit member, respectively. The first and the second attachment connectors 60 and 70 are respectively fitted to the intermediate connector 10 having the circuit boards P and Q form a right angle, and connected thereto in the axes X and Y, which are perpendicular to each other.

The first attachment connector 60 and the second attachment connector 70 will be described again later in this specification. The circuit board members in the invention include not only the circuit boards but also any members that have a circuit and can be attached to the attachment connectors.

As shown in FIG. 2, the intermediate connector 10 holds conducting terminals 30 in a housing 11, which is formed by joining the two housing halves as shown in FIG. 1. The conducting terminals 30 consist of two types of terminals, i.e., a long terminal 31 and a short terminal 36. Each conducting terminal 30 is suitably made with a power source terminal, a signal terminal, a ground terminal, or the like. The housing halves 11A and 11B that form the housing 11 are made by molding an electrically insulating material, and the conducting terminals 30 are made by fabricating a conductive material such as metal by presswork. The two housing halves 11A and 11B are formed so as to divide the housing 11 having a surface containing the axes X and Z, which are perpendicular to each other, as the dividing surface.

Here, as for the axes X and Z, the respective axes X1, Z1; X2, Z2 of the two conducting terminals 30, i.e., the long terminal 31 and the short terminal 36, are provided on the dividing surface. Therefore, for description of the long terminal 31 and the short terminal 36, we use the axes X1, Z1; X2, Z2. And for description of a connector fitting direction, we generally refer as axes X and Z the axes X1 and X2, which are provided on the dividing surface, are horizontal to each other, and direct in the same direction, and the axes Z1 and Z2, which are horizontal to each other and direct in the same direction, are generally referred to as axes X and Z.

Figure 3:
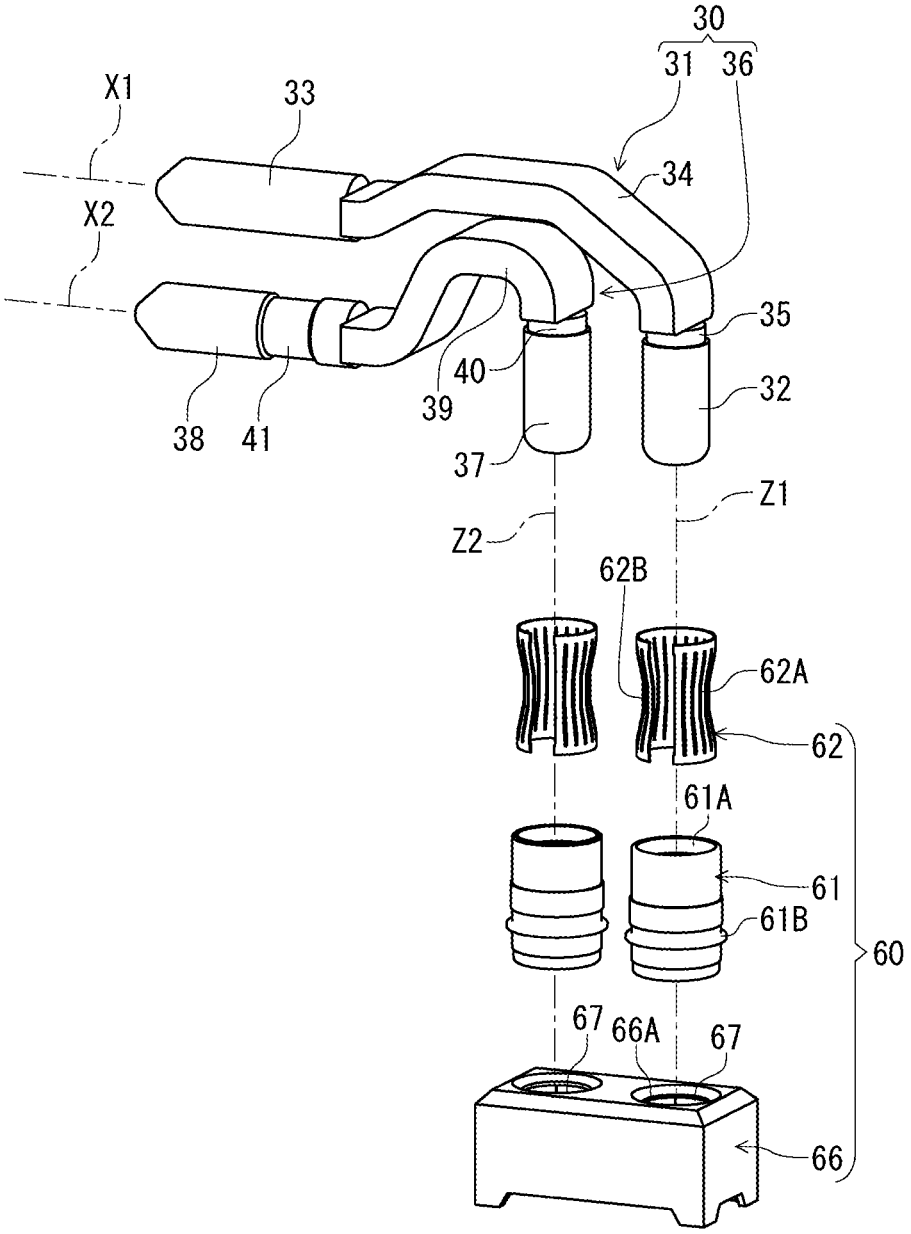
FIG. 3 is a perspective view of conducting terminals of the intermediate connector of FIGS. 1 and 2 and each member of the first attachment connector that are detached from each other.

As shown in FIG. 3, the long terminal 31 of the conducting terminals 30 includes a first contact section 32 that has an axis Z1 extending downward and has a generally cylinder-like shape; a second contact section 33 that has the axis X1 laterally extending being perpendicular to the axis Z1 and has a generally cylinder-like shape; and a joining section 34 that joins the first contact section 32 and the second contact section 33. The long terminal 31 is typically made of a conductive material such as metal, but can be also made of non-conductive material in at least a part of a longitudinal direction thereof and can have its surface made of a conductive material. The short terminal 36, which will be described later, can be made in s similar manner.

The first contact section 32 has a generally cylindrical shape, but is formed such that a circumferential edge thereof is formed to be round towards the lower end, and the second contact section 33 has a generally conical shape with its end side being round. The joining section 34 is formed as a strip section that is bent, with a plate surface thereof is perpendicular to the surface containing the axes X1 and Z1.

In comparison with the first contact section 32 and the second contact section 33, the joining section 34 has its plate thickness smaller than the plate width, has elasticity in the thickness direction, and can be elastically flexed in the direction when receiving external force. At a boundary between the joining section 34 and the first contact section 32, there is formed an annular groove 35 to be held at corresponding portions of the housing halves 11A and 11B.

As also shown in FIG. 3, the short terminal 36, i.e., the other conducting terminal 30, is similarly formed to the long terminal 31 of the above-described conducting terminals 30, and has a first contact section 37 similar to the first contact section 32 of the long terminal 31, and an annular groove 40 that is similar to the annular groove 35 of the long terminal 31, but has a second contact section 38 and a joining section 39 that are slightly different from the second contact section 33 and the joining section 34 of the long terminal 31.

The second contact section 38 of the short terminal 36 has another annular groove 41 near the joining section 39 on its outer circumferential surface such that the second contact section 38 can displace by tilting relative to the housing 11. The joining section 39 joins the first contact section 37 and the second contact section 38 such that the axis Z2 of the first contact section 37 and the axis X2 of the second contact section 38 are perpendicular to each other, and the joining section 39 does not have a L-shape that simply forms 90° angle, but is bent so as to form the curve protruding upward.

The joining section 39 extends upward from an upper end of the first contact section 37, and then quickly bent to form curve protruding upward, then extends diagonally downward towards the left side, and is directed in the lateral direction at the left end and reaches the end of the second contact section 38. Therefore, the upper end of the first contact section 37 is at almost the same position as the second contact section 38 in the up-and-down direction (in a direction of the axis Z2) and although the first contact section 37 and the second contact section 38 of the short terminal 36 are located closer to each other than those of the long terminal 31, the downsizing of the intermediate connector 10 is achieved in the up-and-down direction while fully securing the length for elastic flexibility at the joining section 39.

Because of the upward protruding curved shape of the joining section 39 of the short terminal 36, the joining section 34 of the long terminal 31 is also bent to form a curve protruding slightly upward so as to be along the joining section 39 of the short terminal 36.

As shown in FIG. 2, the long terminal 31 and the short terminal 36 are held between the two housing halves 11A and 11B that form the housing 11, and supported by the both housing halves 11A and 11B.

Figure 5:
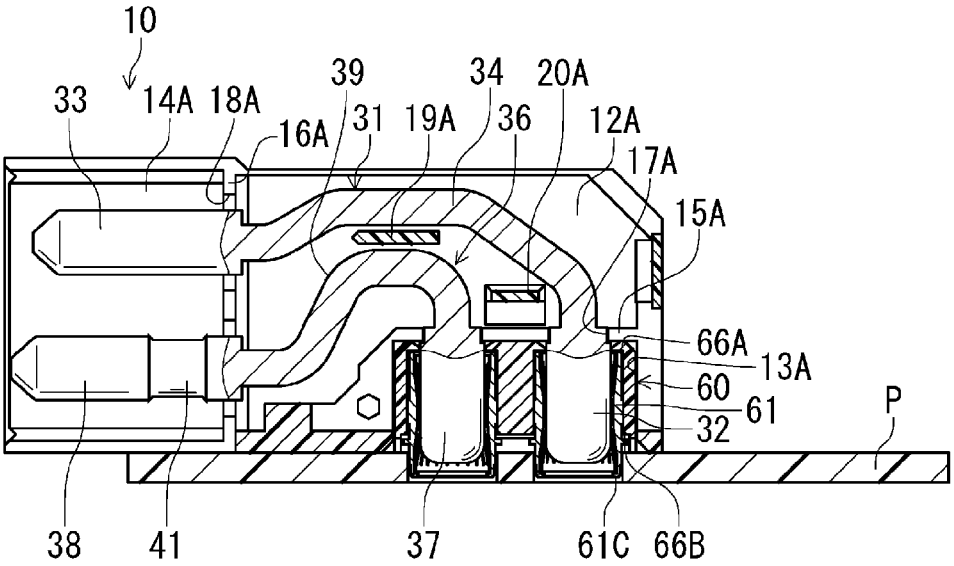
Figure 5:
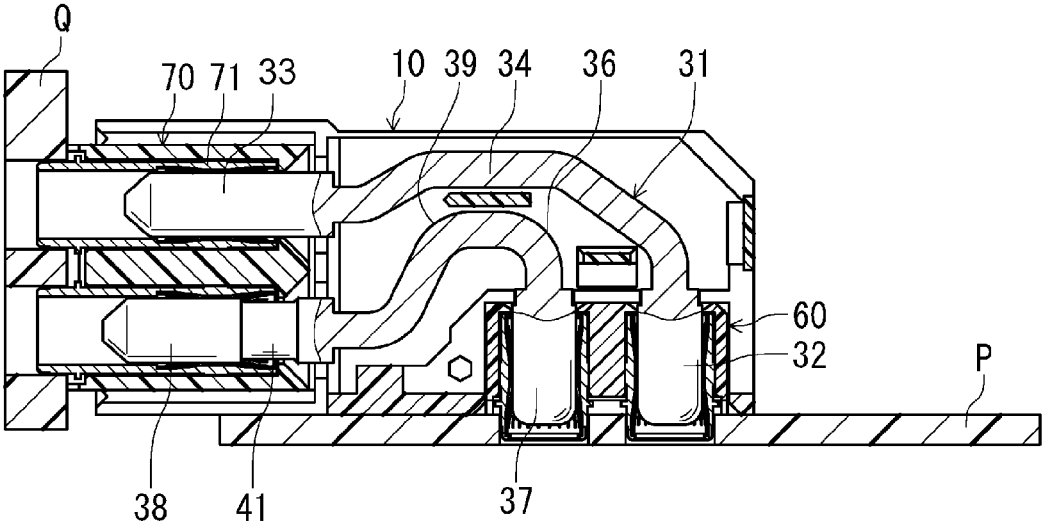

As shown in FIG. 2, one housing half 11A has a terminal housing recess 12A, which provides space to house the joining sections 34 and 39 of the long terminal 31 and the short terminal 36 in the width direction, on one side relative to the housing dividing surface containing the axes X1, X2; Z1, Z2 that are at the center positions of the joining sections 34 and 39 of the two conducting terminals 30, i.e. the long terminal 31 and the short terminal 36, in the width direction; and a first receiving recess 13A and a second receiving recess 14A to similarly receive only half parts of the first attachment connector 60 and the second attachment connector 70 in the width direction (see also FIG. 5(A), which is a sectional view with the other housing half 11B is detached).

The above-described terminal housing recess 12A, the first receiving recess 13A, and the second receiving recess 14A, which are formed on the one housing half 11A, respectively form a terminal housing section, a first receiving section, and a second receiving section with the respective recesses (a terminal housing recess, a first receiving recess, and a second receiving recess) that are formed on the other housing half, which is formed almost symmetrically to the housing dividing surface and is not illustrated in the figure.

The terminal housing section is formed as closed space, and the first receiving section and the second receiving section is formed as cylindrical space that are opened in the directions for fitting to the first attachment connector 60 and the second attachment connector 70. Between the terminal housing recess 12A and the first receiving recess 13A and between the terminal housing recess 12A and the second receiving recess 14A, there are respectively provided dividing walls 15A and 16A. On those 15A and 16A, there are formed notched sections 17A and 18A to dispose the two conducting terminals 30, i.e., the long terminal 31 and the short terminal 36, and penetrate them therethrough (See also FIG. 5(A)).

Furthermore, on the terminal housing recess 12A, two protruding pieces 19A and 20A that protrude from the inner wall surface are provided between the joining sections 34 and 39 of the long terminal 31 and the short terminal 36, so as to prevent the joining sections 34 and 39 contact to each other even when those joining sections elastically displace (See also FIG. 5(A)). The embodiment of the other housing half 11A described above is similar applied to the other housing half 11B. Hereinafter, the parts of the other housing half 11B are indicated with reference numerals of corresponding parts of the one housing half A by affixing "B" instead of "A".

As for the differences between the two housing halves 11A and 11B, while the one housing half 11A has a connecting piece 21A for connecting to the other housing half 11B, the other housing half 11B has a connecting recess section 22B to fit and connect the connecting piece 21A thereto, and the shapes of the bottom walls 23A and 23B of the housing halves 11A and 11B are different (See FIGS. 1 and 2).

The bottom wall 23A of the one housing half 11A is formed to project sideway towards a side wall 11B-1, and the bottom wall 23B of the other housing half 11B projects so as to be on the bottom wall 23A of the one housing half 11A, and the edge of the projection is bent downward to cover the projecting edge of the bottom wall 23A of the housing half 11A. The bottom walls 23A and 23B of the both housing halves 11A and 11B are overlapped to each other, in which there are protrusions 24 at two positions of the projections.

Figure 4:
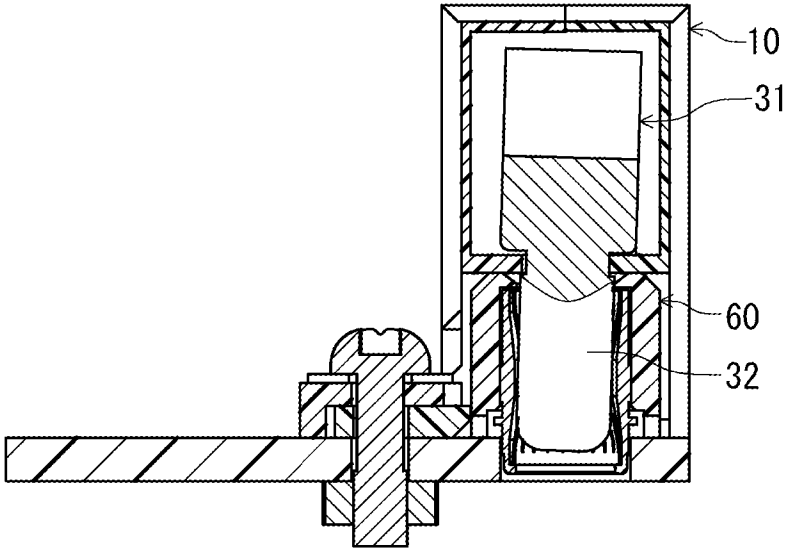
Figure 4:
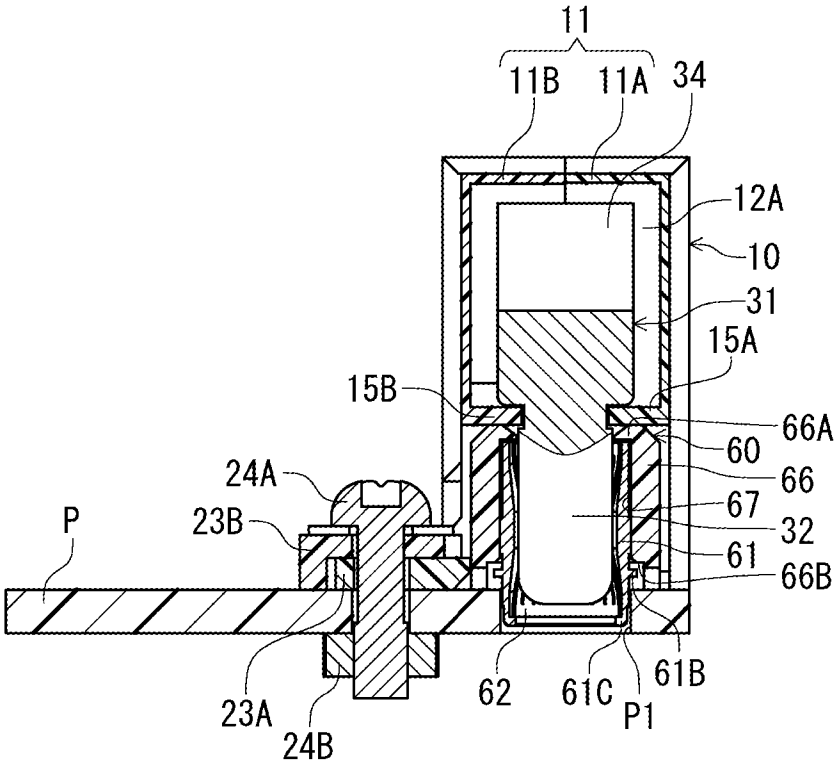

On the protrusions 24, there are formed holes for screws 24A to secure onto the circuit board P, and there is also formed a cutout section 25 to allow entry of the first attachment connector 60 from thereunder within the range of the both side walls of the both housing halves 11A and 11B in the width direction. As shown in FIG. 4(A), the screws 24A secure the intermediate connector 10 onto the first circuit board P cooperating with nuts 24B. Above the cutout section 25, there are provided the first receiving recesses 13A and 13B formed inside the both housing halves 11A and 11B to house the first attachment connector 60, being continuous to the cutout section 25.

Next, as for the mating connectors of the intermediate connector 10, i.e., the first attachment connector 60 and the second attachment connector 70, there are some differences between the first attachment connector 60 and the second attachment 70 in their disposing positions and attitudes and sizes of the composing members, but are formed based on the same principle. Therefore, the description will be provided for the first attachment connector disposed under and the description of the second attachment connector 70 provided on the side thereof is omitted by mentioning the common sections using the same reference numerals in 70s for the same sections. The first and the second attachment connectors 60 and 70 are respectively attached to the first and the second circuit boards P and Q of similar embodiment as circuit members.

As shown in FIG. 3 showing the respective members in a detached state and FIGS. 4(A)-4(B) and 5(A)-5(B) showing the state of being connected to the intermediate connector 10, the first attachment connector 60 includes first receiving terminals 61 that are made of metal and have a cylindrical shape; a housing 66 that holds the first receiving terminals 61 and is made of an electrically insulating material; and elastic cylindrical members 62 that are held in the first receiving terminals 61 and are made of metal. Into the two holding holes 67 formed in the housing 66, the first receiving terminals 61 are respectively held, and the elastic cylindrical members 62 are held in the first receiving terminals 61.

As shown in FIGS. 1 through 5(A)-5(B), the first attachment connector 60 is attached to the first circuit board P that is laterally disposed, and the second attachment connector 70 is attached to the second circuit board Q that is longitudinally disposed.

Each first receiving terminal 61 has a housing hole 61A that has a cylindrical inner surface opened upward in FIG. 3, with that an outer circumferential surface of each first receiving terminal 61 forms a cylindrical outer surface with a step-like section and has an annular protrusion 61B at a middle position in the axial direction. Each housing hole 61A has a step-like annular abutting section 61C (see FIG. 4(A)) on the bottom side of an inner circumferential surface, and defines the position of the elastic cylindrical member 62 in the axial direction.

The housing holes 61A have tapered inner surfaces that are suitable for introducing the first contact section 32 of the long terminal 31, one of the conducting terminals 30, and the first contact section 37 of the short terminal 36, the other conducting terminal 30 of the intermediate connector 10, respectively.

As shown in FIG. 3, each elastic cylindrical member 62 to be housed in the housing hole 61A of the first receiving terminal 61 is formed by first forming slits 62A on sheet metal and then molding to roll into a cylindrical shape. The slits 62A are formed at a plurality of positions in the circumferential direction to extend in the axial direction between the ends in the axial X1 direction of the elastic cylindrical member 62.

The end sections (circumferential edges) in the axial direction form a ring shape because the slits do not extend thereto. By radius-reducing fabrication at the middle part in the axial direction, each elastic cylindrical member 62 has an annular neck section 62B at that portion. When metal sheet is fabricated to have slits 62A and then rolled into a cylindrical shape having the annular neck section 62B, each elastic cylindrical member 62 formed in this way can be formed, such that the abutting sections, which abut to each other in the circumferential direction upon rolling into a cylindrical shape, are separated with gaps but still being able to contact to each other or such that the abutting sections can be connected to each other by welding or the like.

Each elastic cylindrical member 62 is to be held in the housing hole 61A while the radius thereof is temporarily elastically shrunk. After being housed in the housing hole 61A of the first receiving terminal 61, the elastic cylindrical member 62 increases the diameter thereof and recovers its original shape and elastically contacts with the inner surface of the housing hole 61A, and a circumferential edge of one end in the axial direction abuts to the annular abutting section 61C provided on the bottom side of the inner surface of the housing hole 61A, and thereby is to be positioned.

As shown in FIGS. 1 to 5(A)-5(B), the housing 66 to hold the first receiving terminals 61 has an outer shape of a generally rectangular parallelepiped, and has holding holes 67 to house and hold the first receiving terminals 61 at two positions, and each holding hole 67 holds one first receiving terminal 61, respectively and similarly.

As shown in FIGS. 4(A)-4(B) and 5(A)-5(B), the housing 66 has inner annular protrusions 66A, each of which protrudes inward in the radial direction from the inner circumferential edge of the holding hole 67 on the upper side, and restricts the upper end of the first receiving terminal 61 that is inserted from the lower opening side of the holding hole 67.

In addition, on the inner circumferential edge of each lower opening of the housing, there is formed an annular step-like section 66B, to which the annular protrusion 61B of the first receiving terminal 61 abuts. The inner circumferential edges of the inner annular protrusions 66A have a size of an inner diameter such that the first contact sections 32 and 37 of the conducting terminals 30 can enter.

The first attachment connector 60 is attached to the first circuit board P. As shown in FIGS. 4(A) and 4(B) and FIGS. 5(A) and 5(B), the first circuit board P has through holes P1 so that the bottom parts of the first receiving terminals 61 can enter therein without penetrating therethrough, and the inner surface of the through holes P1, the both surfaces of the first circuit board P, and a circuit layer formed therein are provided so as to connect to each other.

Therefore, there is formed slight gaps between the bottoms of the first receiving terminals 61 and the inner circumferential surfaces of the through holes P1, so that solder goes into the gaps and forms connection therebetween, and the first receiving terminal 61 is electrically connected to the circuit layer and thereby the first attachment connector 60 is attached to the first circuit board P.

The second attachment connector 70 is also configured similarly to the first attachment connector 60 and is similarly connected and attached to the second circuit board Q.

The first and the second attachment connectors 60 and 70 and the intermediate connector 10, which are configured as described above, are used in a manner described below.

First, as shown in FIG. 1, the first attachment connector 60 is attached to the first circuit board P and the second attachment connector 70 is attached to the second circuit board Q. Then, the first attachment connector 60 attached to the first circuit board P as described above is positioned so as to direct the first attachment connector 60 upward, then the intermediate connector 10 is brought downward from above the first attachment connector 60, and the lower ends of the conducting terminals 30 of the intermediate connector 10, i.e., the first contact section 32 of the long terminal 31 and the first contact section 37 of the short terminal 36, are inserted in the elastic cylindrical members 62 that are held in the corresponding first receiving terminals 61 of the first attachment connector 60.

If the insertion further progresses, the first contact section 32 of the long terminal 31 and the first contact section 37 of the short terminal 36 move down while elastically increasing the diameter of the annular neck sections 62B of the respective corresponding elastic cylindrical members 62 and reach the predetermined positions. The respective elastic cylindrical members 62, which elastically increased their diameters, elastically contact with the outer circumferential surfaces of the first contact sections 32 and 37, and increase the elastic contact pressure against the inner surfaces of the housing holes 61A of the first receiving terminals 61. Thereafter, the intermediate connector 10 is secured onto the first circuit board P with the screws 24A. For detaching the intermediate connector 10 from the first circuit board P, lift the intermediate connector 10 upward after removing the screws 24A.

Second, the second attachment connector 70 attached on the second circuit board Q is brought close towards the intermediate connector 10, which is connected to the first attachment connector 60, from a lateral direction while directing the second attachment connector 70 in a lateral direction (i.e., having the second circuit board directed in a longitudinal direction), and the conducting terminals 30 of the intermediate connector 10, i.e., the second contact section 33 of the long terminal 31 and the second contact section 38 of the short terminal 36, are received in the elastic cylindrical members 72 of the corresponding second receiving terminals 71 of the second attachment connector 70.

Accordingly, the intermediate connector 10 is also connected to the second attachment connector 70 similarly to the connection to the first attachment connector 60. In this case, since the intermediate connector 10 does not have a screw to be secured onto the second attachment connector 70, the intermediate connector 10 can be released from the connection to the intermediate connector 10 by simply pulling in the lateral direction. Accordingly, the first attachment connector 60 and the second attachment connector 70 are connected by so-called right angle connection, via the intermediate connector 10 (see FIGS. 2 and 5(A)).

As described above, when the first attachment connector 60 and the second attachment connector 70 that are connected via the intermediate connector 10 receive external force that causes displacement or tilting of the first circuit board P and the second circuit board Q, the first attachment connector 60 and the second attachment connector 70 displace and tilt with the circuit boards P and Q.

In other words, even if the first circuit board P and the second circuit board Q maintain the initial relative attitudes of being a right angle from each other, if the surfaces of the circuit boards become relatively displaced in the horizontal direction, the first contact sections 32 and 37 and the second contact sections 33 and 38 of the conducting terminals 30 (the long terminal 31 and the short terminal 36) become tilted relative to each other for the amount of the displacement, and needless to say, the similar thing happens if the circuit boards P and Q become tilted relative to each other.

With reference to the axes X (X1, X2) and Z (Z1, Z2) shown in FIG. 3, FIG. 4(B) shows when the second circuit board Q tilts from the normal position shown in FIG. 4(A) so as to rotate around the axes X1, X2, i.e. X, of the second contact sections 33 and 38 (see FIG. 3).

Figure 6:
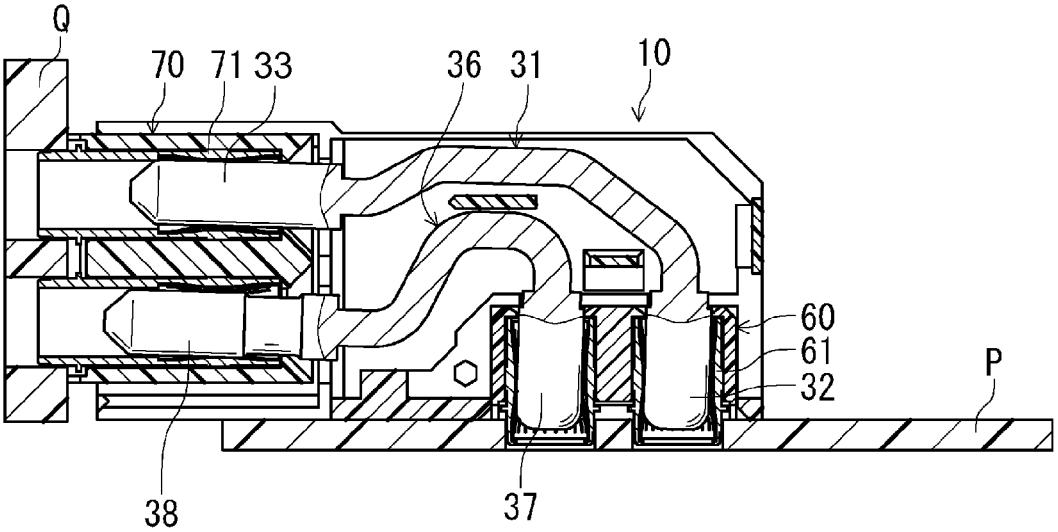
Figure 6:
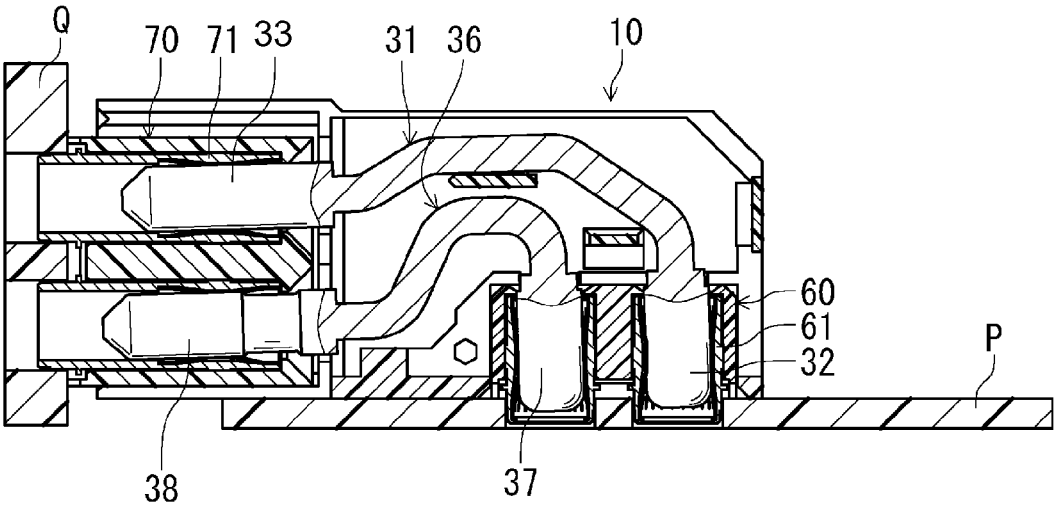

FIGS. 6(A) and 6(B) are sectional views showing the electrical connector assembled component when the second circuit board Q displaces in the up-and-down direction (Z direction) relative to the normal position, wherein the second contact sections 33 and 38 tilt due to displacement upward in FIG. 6(A) and displacement downward in FIG. 6(B).

Figure 7:
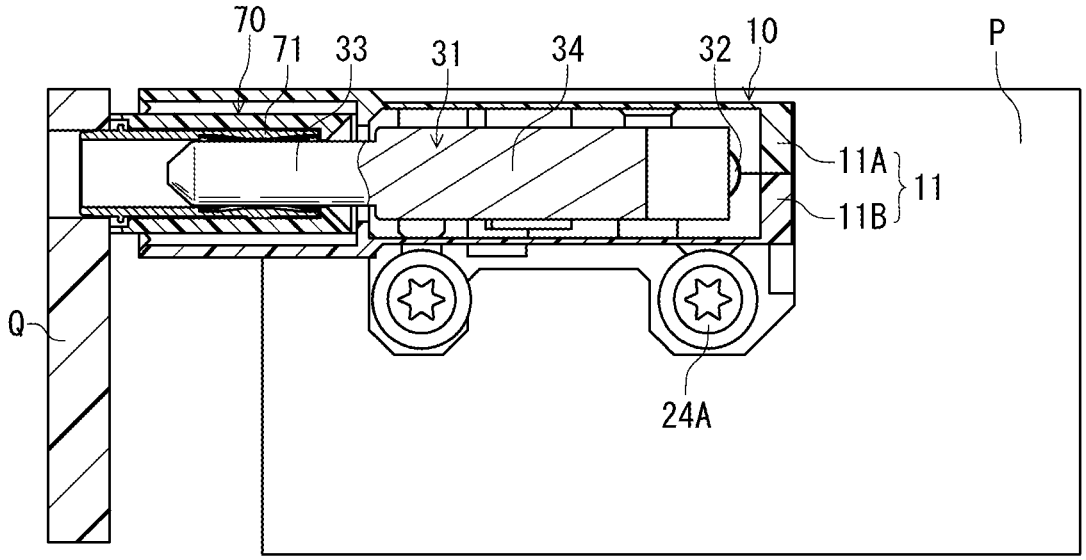
Figure 7:
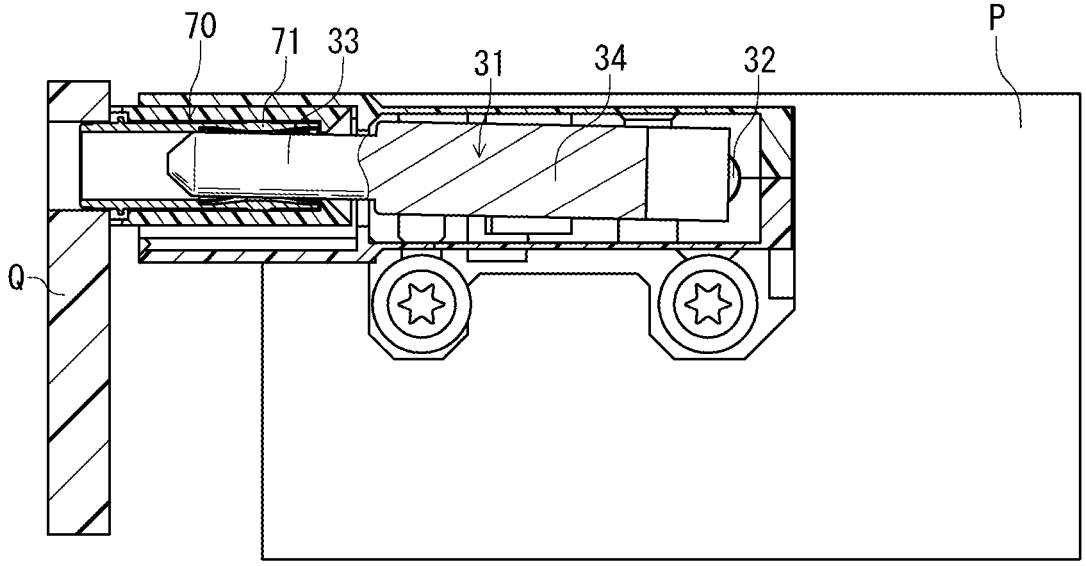

FIGS. 7(A) and 7(B) are sectional views showing the electrical connector assembled component when the second circuit board Q displaces in a Y direction, which is perpendicular to the XZ surface, from the normal position, wherein FIG. 7(B) shows the electrical connector assembled component when the second contact section 33 (38) tilts due to upward displacement of the second circuit board Q from the normal position in FIG. 7(A) within the surface horizontal to the paper surface.

Such tilting could occur either when there is displacement or tilting of the circuit boards P and Q relative to each other without deformation of the conducting terminals 30, the long terminal 31 and the short terminal 36, themselves, or when there is also elastic flexing deformation on the joining sections 34 and 39 of the conducting terminals 30, i.e., the long terminal 31 and the short terminal 36. Here, according to the embodiment, even when the joining sections 34 and 39 are elastically deformed by flexing, since there are provided the protruding pieces 19A, 20A; 19B, 20B on the housing halves 11A and 11B between the conducting terminals 30, the long terminal 31 and the short terminal 36, the terminals 31 and 36 do not contact to each other.

As described above, when the first contact sections 32 and 37 and the second contact sections 33 and 38 generate tilting relative to the first receiving terminals 61 and the second receiving terminals 71 due to the displacement or tilting of the first and the second circuit boards P and Q relative to each other, as shown in the respective figures, the initial axes of the conducting terminals before the displacement become tilted relative to the axes of the receiving terminals. The tilting can occur by the elastic displacement of the elastic cylindrical members 62 of the first attachment connector 60 and the elastic cylindrical members 72 of the second attachment connector 70 in the radial directions.

The elastic displacement of the both elastic cylindrical members 62 and 72 can occur at any angular positions around their axes, and the amounts of the displacement are the same at any angular positions as long as the force to receive is the same. In addition, the elastic cylindrical members 62 and 72 elastically displace independently from each other. The elastic cylindrical members 62 and 72 have the largest elastic displacement at an angular position that the displacement occurs in the circumferential direction, whereas the elastic cylindrical members 62 and 72 have the largest elastic displacement at the positions of their annular neck sections 62B and 72B in the axial directions.

The contact points between the annular neck sections 62B and 72B and the first contact sections 32 and 37 and the second contact sections 33 and 38 form circles before the tilting occurs, but when the tilting occurs, the contact points form an oval due to the tilting.

However, as shown in FIG. 3, in case of the elastic cylindrical members 62 and 72, on which slits 62A and 72A are formed at a plurality positions along the circumferential direction, since the thin strip-like sections between the slits elastically deform in the radial direction, the elastic force (pressure) that works as counterforce onto the first contact sections and the second contact sections works in the radial direction towards the axis at any portions of the thin strip-like sections. Accordingly, the first attachment connector 60 and the second attachment connector 70 are securely in the floating state via the intermediate connector 10, even in case of the right angle connection.

According to the embodiment, since the first contact sections and the second contact sections extend in the perpendicular directions from each other and the whole conducting terminals form L-shapes as a whole, the terminals disposed on the inner side (disposed under the long terminal 31) has a shorter length.

More specifically, in case of the short terminal 36 provided under the long terminal 31, for example, even when the end of the second contact section 33 of the long terminal 31 and the end of the second contact section 38 of the short terminal 36 displace for the same amount due to the displacement of the second circuit board Q, influence of the tilt angle on the second contact section 38 of the short terminal 36 is greater than that on the second contact section 33 of the long terminal 31 in view of the tilt angle per the whole length of the second contact sections. In order to eliminate the influence, according to the embodiment, there is formed an annular groove 41 on the second contact section 38 of the short terminal 36, whereby it is possible to eliminate the issue caused by its abutting with a corresponding part of the housing 11 upon tilting of the second contact section 38.

The invention is not limited to the embodiments shown in FIGS. 1 to 7(A)-7(B), and various alterations, modification, and changes are possible.

Figure 8:
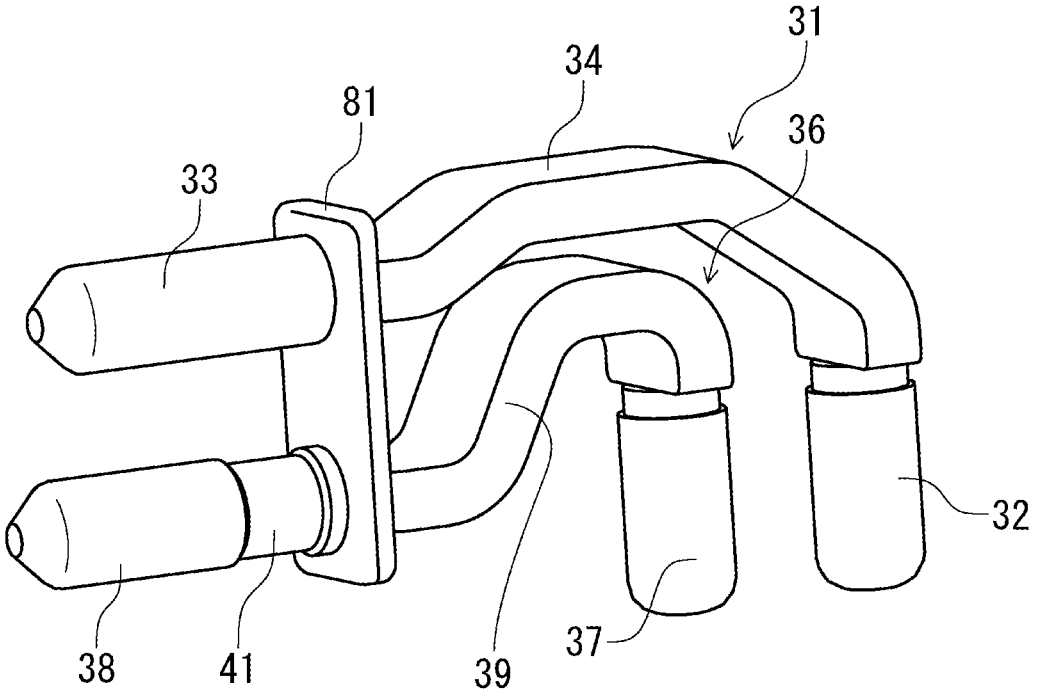
FIG. 8 is a perspective view of the conducting terminals according to another embodiment of the present invention.

For example, as shown in FIG. 8, it is possible to partially hold the conducting terminals 30, i.e. the long terminal 31 and the short terminal 36, with a holding member 81 that is made of an electrically insulating material. With this configuration, it is not only possible to keep the relative positions inside the housing 11 of the intermediate connector 10, but also convenient for storage of members prior to assembling into the housing 11 and workability upon assembling.

Figure 9:
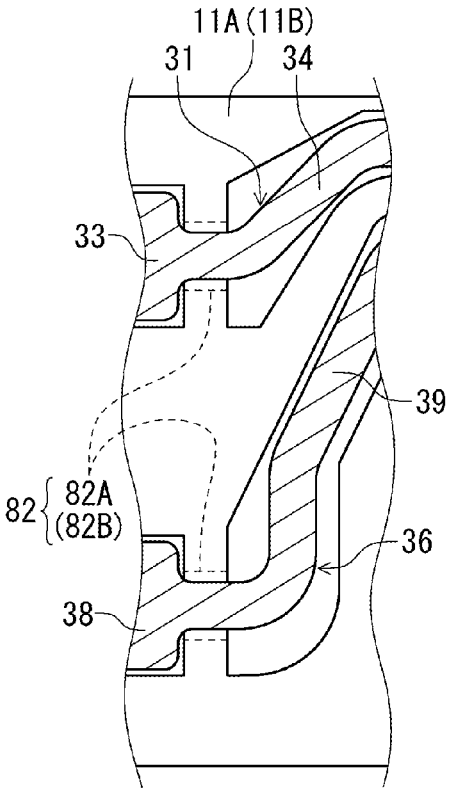
Figure 9:
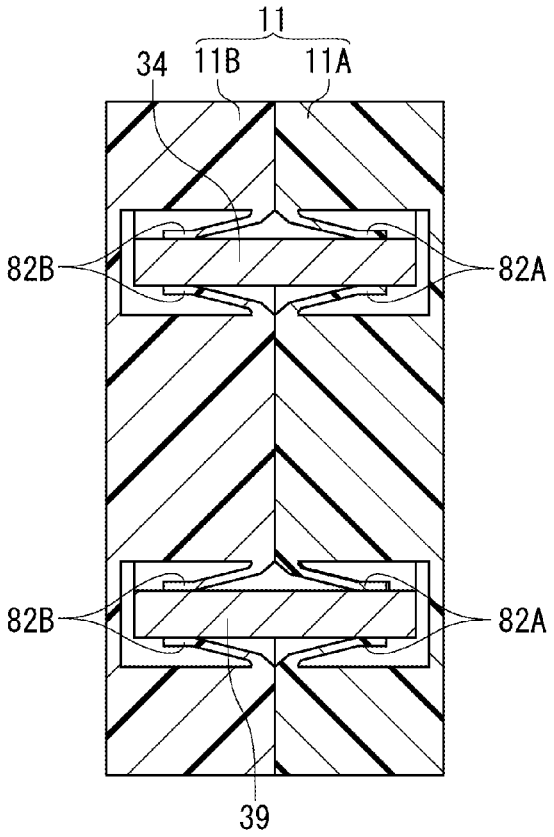

Furthermore, as shown in FIGS. 9(A) and 9(B), it is preferred to support the long terminal 31 and the short terminal 36 with spring members 82. In FIGS. 9(A) and 9(B), thin spring members 82A and 82B having elasticity are formed as parts of the housing halves 11A and 11B, and with the spring members 82A and 82B, the joining section 34 of the long terminal 31 and the joining section 39 of the short terminal 36 are tightly held and supported with parts of the spring members 82A and 82B from above and below.

With this configuration, while securing the degree of freedom in displacement of the joining section 34 and the joining section 39, it is possible to support the joining section 34 and the joining section 39 at set positions.

The disclosure of Japanese Patent Application No. 2012-275677 filed on Dec. 18, 2012, is incorporated in the application by reference.

While the invention has been explained with reference to the specific embodiments of the present invention, the explanation is illustrative and the invention is limited only by the appended claims.

What is claimed is:

1. An electrical connector assembled component comprising:

a first attachment connector be attached to a first circuit board;

a second attachment connector to be attached to a second circuit board; and an intermediate connector disposed between the first attaching connector and the second attaching connector for connecting the first attaching connector to the second attaching connector, wherein said intermediate connector includes a housing and a first power source terminal disposed in the housing, said first power source terminal includes a first contact portion at one end portion thereof, a second contact portion at the other end portion thereof, and a joint portion joining the first contact portion and the second contact portion so that a first axial line of the first contact portion crosses a second axial line of the second contact portion, said first attaching connector includes a first receiving terminal for receiving and contacting with the first contact portion, said second attaching connector includes a second receiving terminal for receiving and contacting with the second contact portion, at least one of said first receiving terminal, said second receiving terminal, said first contact portion, and said second contact portion includes an elastic cylindrical member so that the first contact portion and the second contact portion are capable of inclining and moving in a radial direction at an arbitrary angle position along a circumferential direction around the first axial line and the second axial line, and said elastic cylindrical member includes a circumferential surface contacting between the first contact portion and the first receiving terminal and/or between the second contact portion and the second receiving terminal in an elastically deformed state.

2. The electrical connector assembled component according to claim 1, wherein said joint portion is formed of a plate member having a plate surface extending in a direction perpendicular to a plain containing the axial line and the second axial line.

3. The electrical connector assembled component according to claim 1, wherein said housing includes a first housing half body and a second housing half body, and said first housing half body and said second housing half body are divided along a plain containing the axial line and the second axial line so that the first housing half body is attached to second housing half body.

4. The electrical connector assembled component according to claim 1, wherein said intermediate connector further includes a second power source terminal disposed in the housing, and a holding member for holding the first power source terminal and the second source terminal.

5. The electrical connector assembled component according to claim 1, wherein said intermediate connector further includes a spring member disposed between the joint portion and the housing for holding the first power source terminal.

6. The electrical connector assembled component according to claim 1, wherein said elastic cylindrical member is formed of a metal plate having a cylindrical shape, said elastic cylindrical member includes a plurality of slits extending in an axial line direction along the circumferential direction and disposed between end portions of the elastic cylindrical member in the axial line direction, and said elastic cylindrical member includes a ring shape contracted portion at a middle portion thereof in the axial line direction, said ring shape contracted portion having a diameter smaller than that of the end portions of the elastic cylindrical member in the axial line direction so that the elastic cylindrical member is capable of being retained in the first receiving terminal and/or the second receiving terminal.

* * * * *